United States Patent [19]

Mugica

[11] Patent Number: 4,688,414

[45] Date of Patent: Aug. 25, 1987

[54] PRODUCTION PROCEDURE OF BRAKE SHOES

[76] Inventor: Marcos O. Mugica, Echegaray 12, Gernika (Vizcaya), Spain

[21] Appl. No.: 924,874

[22] Filed: Oct. 30, 1986

Related U.S. Application Data

[63] Continuation of Ser. No. 754,229, Jul. 12, 1985, abandoned.

[30] Foreign Application Priority Data

Jul. 13, 1984 [ES] Spain ..... 534.282

[51] Int. Cl.[4] ..... B21D 7/08; B21D 11/10

[52] U.S. Cl. ..... 72/167; 72/133; 72/166

[58] Field of Search ..... 72/167, 166, 170–175, 72/179, 182, 133; 29/150

[56] References Cited

U.S. PATENT DOCUMENTS

| | | | |
|---|---|---|---|
| 1,418,955 | 6/1922 | Mason | 72/171 |
| 1,673,477 | 6/1928 | Yates | 72/167 |
| 1,875,081 | 8/1932 | McConkey . | |
| 1,879,568 | 9/1932 | Sneed | 72/171 |
| 1,905,515 | 4/1933 | Smith . | |
| 1,943,407 | 1/1934 | Yoder | 72/171 |
| 2,047,084 | 7/1936 | Smith | 72/167 |
| 2,093,933 | 9/1937 | Sinclair | 72/167 |
| 3,808,863 | 5/1974 | Marcovitch | 72/199 |
| 3,842,473 | 10/1974 | Couper | 72/166 |

FOREIGN PATENT DOCUMENTS

| | | | |
|---|---|---|---|
| 2511900 | 3/1983 | France | 72/166 |
| 727269 | 4/1980 | U.S.S.R. | 72/166 |
| 1039607 | 9/1983 | U.S.S.R. | 72/166 |

*Primary Examiner*—Daniel C. Crane

*Attorney, Agent, or Firm*—Browdy and Neimark

[57] ABSTRACT

Process of manufacturing brake shoes characterized in that a T section profile (1) is passed between a pair of rollers (6) and (7) of which one (6) is plain—and the other (7) of which has an annular groove (8), in which the stem (4) of the T (1) is freely disposed, the rolling of the upper and lower faces of the flange (3) of the T (1) being carried out between rollers (6) and (7). Thus, flange (3) becomes elongated and this elongation goes to the stem (1) of the said T in such a way that after the T emerges from between the rollers it adopts the curvature of the latter, whose external diameter is equal to the diameter (5') of the lower face of the flange (5) of the shoe. In another aspect of the invention, a brake shoe is formed by the method described above.

3 Claims, 11 Drawing Figures

PRODUCTION PROCEDURE OF BRAKE SHOES

This application is a continuation of application Ser. No. 754,229, filed July 12, 1985, now abandoned.

BACKGROUND OF THE INVENTION

Information has been supplied on the so-called "pads for drum brakes" used on friction brakes, where there is a drum and at least one pad with its friction lining, lined for example. Upon applying a force on the pad or shoe, it actuates on the drum and by friction between the friction lining and drum the vehicle is brought to halt. The external shape of these shoes is of a general circular configuration and they are, as already mentioned, conventional elements used on all types of vehicles.

The conventional manufacturing processes of these vehicle shoes is well known and they are constituted by a core and wing made independently, which are adequately welded so as to form the final T shaped section of the shoe. The core and wing are machined so that they can serve as a base for the different mechanisms and as a linking nexus for others, and on the external surface of the wing, for example, there are lining plates through which the braking operation of the vehicle is performed.

During the operation of these shoes, several types of problems and failures arise, mainly originating from the weld tacks applied to join the wing and core, which on certain occasions cannot withstand too much stress and both elements fall apart with the subsequent uselessness of the clamp. Moreover, the manufacturing process is extremely cumbersome as it necessary to make a core with a series of holes, grooves . . . etc., depending on the brake model of the vehicle where it is to be applied, and also involves a wing produced from a flat iron, both of them being curved so that it is possible to superimpose the core over the wing, so as to weld both elements.

As mentioned before and apart from the constructive complexity, the application of welds originates certain problems, which are:

A practical impossibility of achieving a "perfect" weld between the core and wing.

A lack of uniformity in the distribution of the material used on the weld.

Internal material stresses upon welding.

A lack of a regular section in the shoe, as a tack welding procedure is used.

Lack of safety during the operation of the brake as the core and wing usually fall apart, with the subsequent risk for the vehicle's braking operation.

Within the present state of the art, there is U.S. Pat. No. 1,943,407 where a machine is detailed for the folding of T shaped sections, in an arched shape, where there is a roller, preferently formed by two joined-up parts, which form a groove between them where the T profile stem is located, and where the said T profile stem is maintained by friction against the walls of the said groove. In combination with this roller, there are also other peripheral rollers distributed around the main one where the head of the profile contacts when the main roller turns so as to gradully bend the profile and gradually adjust it more or less accurately, to the said main roller. This machine supplies a T section arched element, where the said arched T is obtained by successive bending actions by means of the peripheral rollers and in which the T that is obtained does not fit onto an axactly circular shape of its main roller (FIG. 12). The machine of this patent positions the ancillary rollers on the sole element that surrounds the main one and also contains a final stop (41') where it contacts with the T-shaped profile, already arched, so as to be extracted.

The assembly and constitution of this bending machine can eventually become expensive, and the T shaped profile does not modify its structure in a substantial manner from its initial straight shape until its final arched shape.

U.S. Pat. No. 2,047,084 is also known which, based on the knowhow of the aforementioned, mentions the existence of a recess on the external surface of the T shaped head, in its position directly opposite the T stem. In order to avoid this problem, Pat. 2,047,084 provides a method used to form brake shoes, whereby there is a main split rollers, with a groove or channel between both that applies pressure onto the stem of the T inside it, and another four rollers gradually bend the T shaped part in several successive stages, with the rollers maintaining the head of the said T fully clamped and also collecting portions of the main roller.

This system requires the existence of a main roller and of other bending rollers whose mission is to adjust the arched T to the main conductor roller in a complicated and costly layout.

U.S. Pat. No. 3,808,863 is also well known, which includes a method and a machine that rolls the entire contour of a T shaped section and which, in order to supply an arched T, has a bending roller (34) at the exit of the rolling assembly. The arched shape of the T section obtained does not fit onto any specific radius. The stem of the T is held between two rollers with a considerable amount of pressure and essentially executes two different and separate operations, one rolling and the other bending.

In the face of these techniques, the invention supplies a form of carrying out a base body for the production of shoes for brakes, which is economical, easy to assemble and simple to install.

SUMMARY OF THE INVENTION

One of the invention's objectives is a system of making shoes for brakes where the upper and lower faces of the head of a T are laminated between two laminating rollers while the stem of the T is maintained free and without any action whatsoever on the same.

Another objective of the invention is the fact that, because of the effect of the rolling of the upper and lower faces of the T's head, the T profile adjusts itself to the peripheral contour of the lower rollers, adopting a curvature identical to that of the said roller.

Another point of the invention is the fact that the stem of the T takes up a circular space of the lower roller in whose space it circulates freely.

For putting into practice the aforementioned procedure, a billet or T shaped profile is used, and in either case, the said billet or T profile, are cold or hot rolled and, obviously, by traditional rolling procedures. The objective of this previous operation is to constitute a T shaped section, in which its dimensions are consonant with those of the brake shoe to be produced in the end. As far as this is concerned, we would like to point out that, as there are many different core and wing dimensions on the different shoes used for vehicles, this special T that is obtained shall be of variable dimensions according to the final section to be achieved, as will be discussed in further detail hereinafter. In principle, however, it is pointed out that the special T obtained by means of these first rolling operations shall have the characteristic of their core, in height and width, substantially corresponding with that of the cross section of the finished shoe.

These previous operations can be performed in one or more passes through the laminating rollers, depending on the type of section used and on the specific section to be achieved.

The operation includes the rolling of the upper and lower faces of the head of that special longitudinal section thus obtained inside the space left between the two cylinders, where one of the said cylinders has a centred circular groove where the stem of the special longitudinal T lies, while in the space between cylinders is located the head of the T. The stem of the T must be able to circulate freely inside the groove.

The cylinder with the groove presents a basic feature which is that of its diameter which fits exactly onto a measurement that will correspond with that of the external diameter of the brake drum, minus double the thickness of the pad and minus double the height or thickness of the wing of the finished shoe, as shall be seen hereinafter in further detail.

The distance between the cylinder is less than the height of the head of the profile. Upon initiating the rolling process under that diameter for the grooved cylinder, the head of the special profile inserted between both the cylinders and starts to reduce in height and logically increases in width. The stem of the profile is moved freely within the circular channel of the pertinent cylinder and at the outlet of the profile of this final assembly, a free exit is given to the same, so that with the rolling effect, a sort of sliding of the core's metal particles close to the head takes place, which is of such a nature that the profile, at its outlet, adjusts itself to the external surface of the grooved cylinder and travels along it when the external surface rotates. Consequently, the conditioning and contact between the outlet profile and cylinder eventually achieves a T shaped cross section element with a bend or general radius component equal to that of a shoe for a brake to be elaborated based on the element.

As can be deduced very easily, this element is adjusted throughout the lower cylinder's entire circumferential perimeter so that it eventually becomes necessary to separate the same, and this is obvious as its circular travel would even contact with the entry of the special profile into the laminating assembly. This is why the stop can be located near the outlet and at a convenient distance against which the element contacts during its rotation, so that upon impending the continuity of the element upon the cylinder, the bent part comes off.

This process of the constitution of elements, one by one, can be established whenever the grooved cylinder is monolithic. However, the production of different elements can be increased, for example, by having two lower cylinders, at a certain distance from each other, which shall receive the core of the special profile. One of the cylinders is fixed in an axial direction and the other can be moved along its longitudinal axis. When the element surrounds the assembly of both cylinders, the latter moves away from the other and at the same time with a pawl joined to it, contacts with the end of the profile's head resting atop the axially fixed cylinder, with which the hoop produced by the element is left free and revealed, falling by gravity. This hoop shall be longer than the unitary to make a single brake shoe. As soon as this element falls, the moving cylinder returns to its initial position and continues with another element.

In the case of the unitary manufacturing, the element that is collected and produced by this lamination constitute a base part for the making of a brake shoe, by simple machining, by die-forging for example, of the same, so as to provide the necessary recesses, hole, torn zones, etc . . . for its wings, that correspond to the final shape of a shoe applicable to a given vehicle. In the machining process, which in itself does not represent an insurmountable technical problem, it so happens that, if necessary, the die forging operations would absob any possible irregularity detected within the element, finally constituting a shoe ready to be used.

During the rolling phase for the execution of the base element, it has already been mentioned that the metal particles experience a sliding action which is usually determined after this operation, that the thickness of the element's core is reduced in the portion of the same annex to the head. Generally speaking, this decrease does not represent a detriment in the intrinsic resistance of the element itself nor in the finished shoe. However, and in those cases in which it is considered necessary to have more safety, the special profile shall be made before the bending operation, with the joining zones between the core and head overdimensioned, for example, with a higher than normal bending angle. Thus there would be a higher concentration of material in the said zone which, upon decreasing the thickness in the bending operation, as mentioned before, would not produce any difference at all in the bent element, more specifically, in the thickness of its core, that would be even.

Depending on several factors, such as the quality of the material to be used, the thickness of the body of the shoe to be made . . . etc., the process of the invention can vary in certain non-basic concepts. Thus, the grooved cylinder can be the upper one; the diameters of the upper and lower cylinders can be equal or different; both cylinders can have different rugosity on their external surface.

One has to bear in mind that there are many types of shoes for different vehicles, and that it would be impossible to apply only one standard or operational mode. Thus, in practice, the variations mentioned are within the scope of the invention, conserving the constants mentioned before as regards the constitution of a special rolled profile under the conditions set forth, the exact diameter of the grooved cylinder and the free exit of the profile once it has been bent.

Other solutions and receiving devices at the exit of the profile from the laminating assembly can be considered, in order to speed up and confer higher production rates to the manufacturing procedure in order to produce units at a better rate. The invention, however, does not consider this particular point which is subject to latter criteria, as a function of its demand and capacity.

BRIEF DESCRIPTION OF THE DRAWINGS

On the basis of the aforementioned and for its efficient interpretation, drawings are hereto attached, where the following is shown, as described hereunder.

DETAILED DESCRIPTION OF THE PREFERRED EMBODIMENTS

Figure 1:
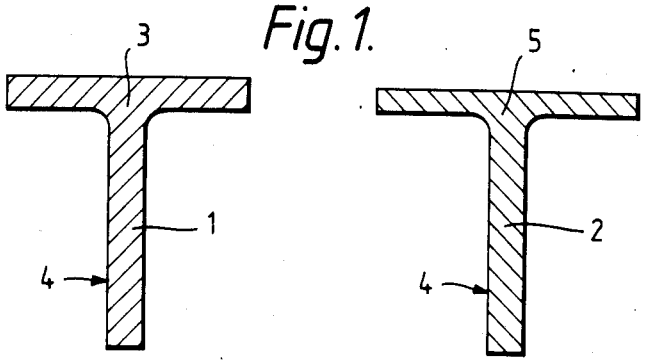
FIG. 1, shows two T sections belonging to the base profile and to the bent profile.

Regarding these figures, in FIG. 1 the sections of two profiles (1) and (2) can be seen, where profile (1) is a special profile obtained by hot or cold welding, with a head or upper portion (3) and a core (4) of adequate proportions. This special profile (1) has its head (3) oversized in relation to the one that is to be obtained from it and its core (4) approximately coincides with the core of the final profile (2). This is the characteristic that profile (1) must have in order to attain the objective of the invention.

Figure 2:
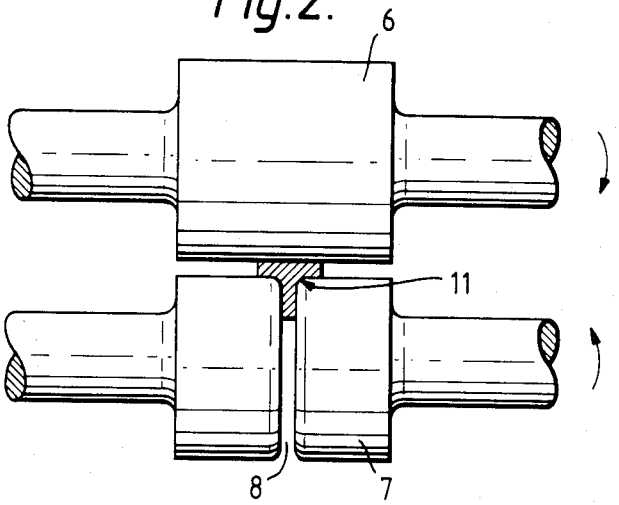
FIG. 2, is a view of the assembly of laminating cylinders used in the forming process of the special profile, according to the points laid down in the invention.

Once this profile has been prepared, it is inserted in the space left between cylinders (6) and (7) of FIG. 2, so that the profile's stem (4) is located inside the cylinder's (7) groove (8), and in which both cylinders (6) and (7) turn in opposite directions, as is obvious.

While the profile's (1) head is being laminated or deformed and the previous head (3) modified, the outgoing head (5) tends to elongate itself by dragging the stem along with it. This elongation of the head makes (FIG. 5) the outgoing profile adapt perfectly well to the external surface of the lower cylinder travelling alongside it. As the external cylinder diameter (7) corresponds to the diameter of the internal face of the shoe head to be achieved, the profile is laminated and bent with its bending radius perfect and adjusted to the desired radius.

Figure 5:
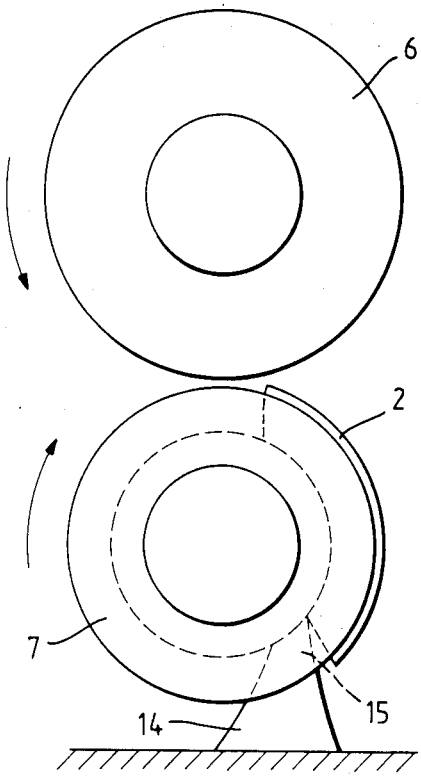
FIG. 5 is a side view of the bending laminating rollers where the bent profile stop is included.

At the outlet, and in order to collect laminated and bent profile units; FIG. 5, shows the layout of a stop (15) mounted on a base (14); this stop interrupts the profile's (2) travel on the roller (7), so that the portion of bent profile is automatically separated from the cylinder.

Figure 3:
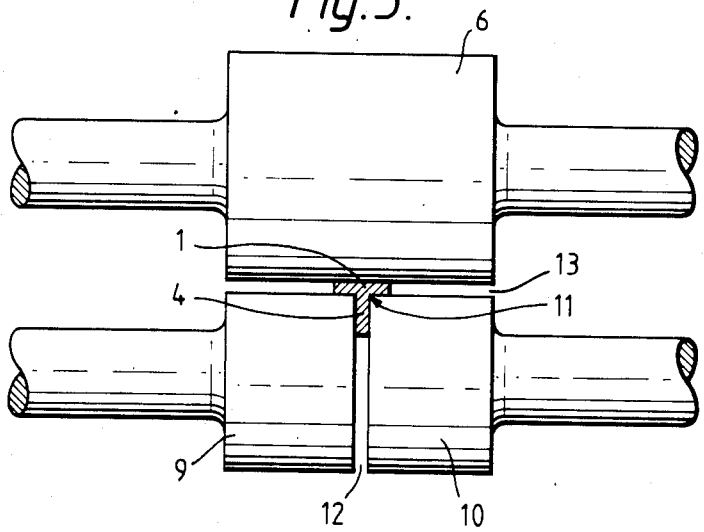
FIG. 3 shows a variant of the layout of the above figure.
Figure 4:
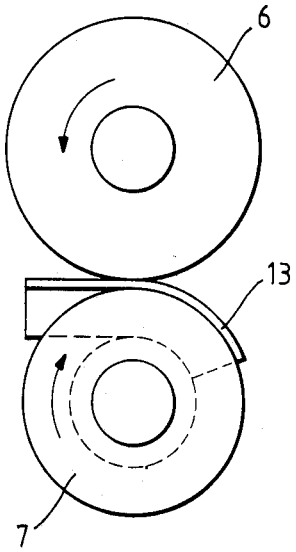
FIG. 4 is a view from the left of FIG. 2.
Figure 6:
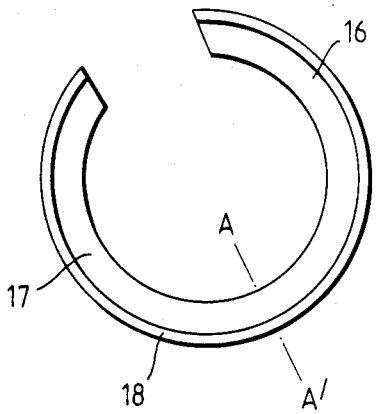
FIG. 6 is a top view of a hoop constituted by the adopted double part solution.

In FIG. 3 we can see one of the invention's solutions, where there are two lower cylinders (9) and (10) with the same axis, laid out at an adequate distance (12) which leaves enough space for the reception of the profiles (1) stem (4). In this case, the cylinder (10) could be fixed in the axial direction and the moving cylinder (9) axially, so that the profile that has already been laminated (2) and bent will get to the lower cylinders and where without interruption of the stop (15), higher profile (2) lengths can be obtained, for example like the one (18) shown in FIG. 6, that can be consecutive from the production of two bodies (16)–(17) for obtention of shoes.

Figure 7:
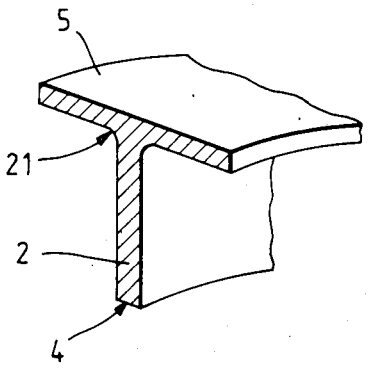
FIG. 7 shows the AA' cross section made in the previous figure.
Figure 8:
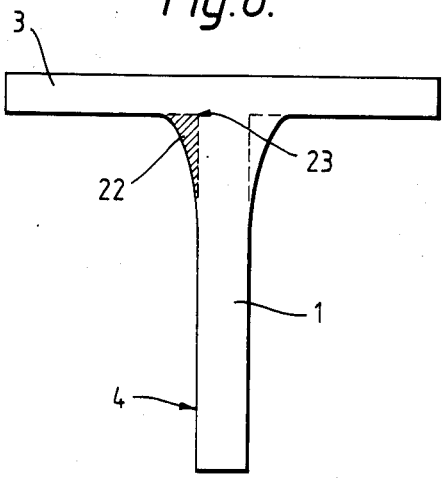
FIG. 8 is a schematic representation of the joining portion of the special profile head and stem just before the bending operation.

By the effect of the rolling of the head that already been mentioned before, the metal particles of the profile's core slide and can produce a reduction (21) (FIG. 7) in the stem (4) of the bent profile (2). Even though this slight thinning does not impair the finished part's resistance, it can be eliminated perfectly well and without modifying the process, by means of the prior oversizing of portion (22)–(23) of profile (1) of FIG. 8. At the same time, the edges (11) of cylinders (9) and (10) (FIG. 3), as well as those of the sole cylinder (7) (FIG. 2), if pertinent, shall be adjusted to the said oversizing in order to control the final section of the part in zone (21).

Figure 9:
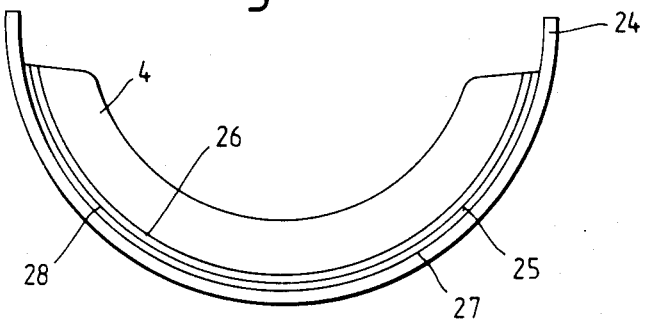
FIG. 9 shows a shoe already positioned inside the drum.

With regard to FIG. 9, we shall point out that in it appears a shoe for a brake (4) according to the invention, mounted in its drum (24) and with the lining plate (25) located on the external surface of the same. The diameter of the cylinder (7) and, if pertinent, the diameters of cylinders (9) and (10) shall have the same dimension than the one belonging to item (26), or equal to the outer diameter of the brake drum (27) minus double the thickness of the lining (25) minus double the height of the wing of the shoe (4) (26)–(28), as will be seen easily.

Figure 10:
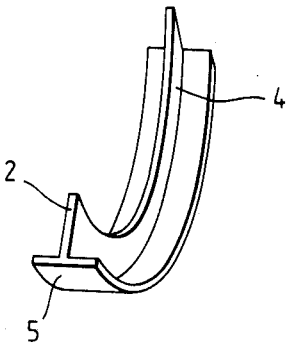
FIG. 10 is a perspective of the body obtained according to the invention.
Figure 11:
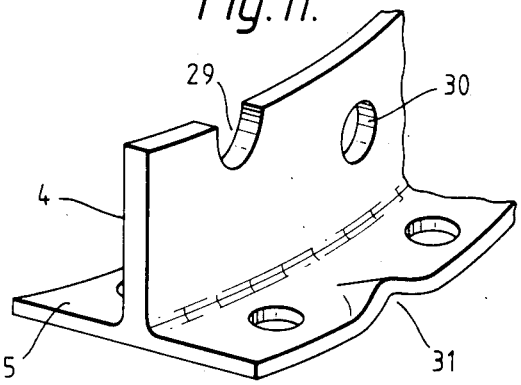
FIG. 11 finally shows the body for the shoe already made after the die-forging operations.

In this situation a base profile is produced for the production, on the basis of the same, of a shoe of the type shown in FIG. 10 where a compact element is constituted, without any cracks at all and with an internal structure perfectly capable of resisting any external pressure. Once this body has been made, the pertinent machining operations are carried out on the same in order to adjust them according to the type of shoe that is to be made, as schematically shown on FIG. 11. The maching is done from the head, recess (31) or others, from the stem (4) with the pertinent orifices (30) . . . etc. etc.

I claim:

1. A method of manufacturing a curved brake shoe having a lower face with a shoe head, consisting essentially of the steps of:

providing a first laminating roller having a rolling surface, a radially extending circular groove being on said rolling surface;

providing a second laminating roller having a plain rolling surface defined by a continuous cylindrical shape throughout its length, said first and second laminating roller each having a rotational axis, said rotational axes being essentially parallel to each other, a space being defined between the rolling surfaces of said first and second rollers;

passing a T-shaped profile comprising a metal suitable for use as a brake shoe between said first and second laminating rollers, said T-shaped profile having a head with a height greater than the width of said space, and a tail with a width about equal to the width of, and length relative to, said radially extending circular groove, so that the entry of said tail extends freely into said radially extending circular groove and said head of said T-shaped profile is pressed between said space between said rolling surfaces to reduce the height of said head of said T-shaped profile;

the radius of curvature of said plain rolling surface of said second laminating roller being greater than the radius of curvature of said rolling surface of said first laminating roller, to such an extent that said T-shaped profile passed between said first and second laminating rollers forms a brake shoe with a lower face having a curvature corresponding to that of said rolling surface of said first laminating roller and a radius of curvature about equal to that of said rolling surface of said first laminating roller;

whereby, said passing step bends said T-shaped profile in the direction of said tail, to the curvature, and about the radius of curvature of said rolling surface of said first laminating roller.

2. The method of claim 1 wherein said tail is wider at an end thereof joining said head of said T-shaped profile than at an end thereof opposite said end joining said head of said T-shaped profile.

3. The method of claim 1 wherein said radially extending circular groove has rounded edges.

* * * * *